United States Patent [19]

Shyu

[11] Patent Number: 4,703,634

[45] Date of Patent: Nov. 3, 1987

[54] LEATHER PRODUCT EDGING MACHINE

[76] Inventor: Jang M. Shyu, 12, Sublane 2, Lane 47, Juang Jin Rd., Juang Jin Tsun, Pin Jenn Shien, Taoyuan, Taiwan

[21] Appl. No.: 841,678

[22] Filed: Mar. 19, 1986

Related U.S. Application Data

[63] Continuation-in-part of Ser. No. 601,964, Apr. 19, 1984, abandoned.

[51] Int. Cl.[4] ..... C14B 11/00

[52] U.S. Cl. ..... 69/7.7; 69/46; 12/55.1

[58] Field of Search ..... 12/52.5, 55, 55.1; 69/7.7, 46

[56] References Cited

U.S. PATENT DOCUMENTS

| | | | |
|---|---|---|---|
| 1,264,136 | 4/1918 | Alexander | 12/55.1 |
| 1,488,959 | 4/1924 | Towle et al. | 69/7.7 |
| 1,725,929 | 8/1929 | Newton | 12/55 |

*Primary Examiner*—Wm. Carter Reynolds

*Attorney, Agent, or Firm*—Browdy and Neimark

[57] ABSTRACT

An edging machine for leather products, particularly for the flanging as well as edging of the vamp or quarter of leather shoes or leatherette shoes, incorporates a cam shaft on which there are provided a cam, curved wheels and further eccentric cams which facilitate the automatic operation of a claw that progressively moves the leather product for flanging by a flanging member. Thus, the edging of leather products is accomplished at an improved product quality level as well as a cut in product cost as compared with conventional procedures.

4 Claims, 15 Drawing Figures

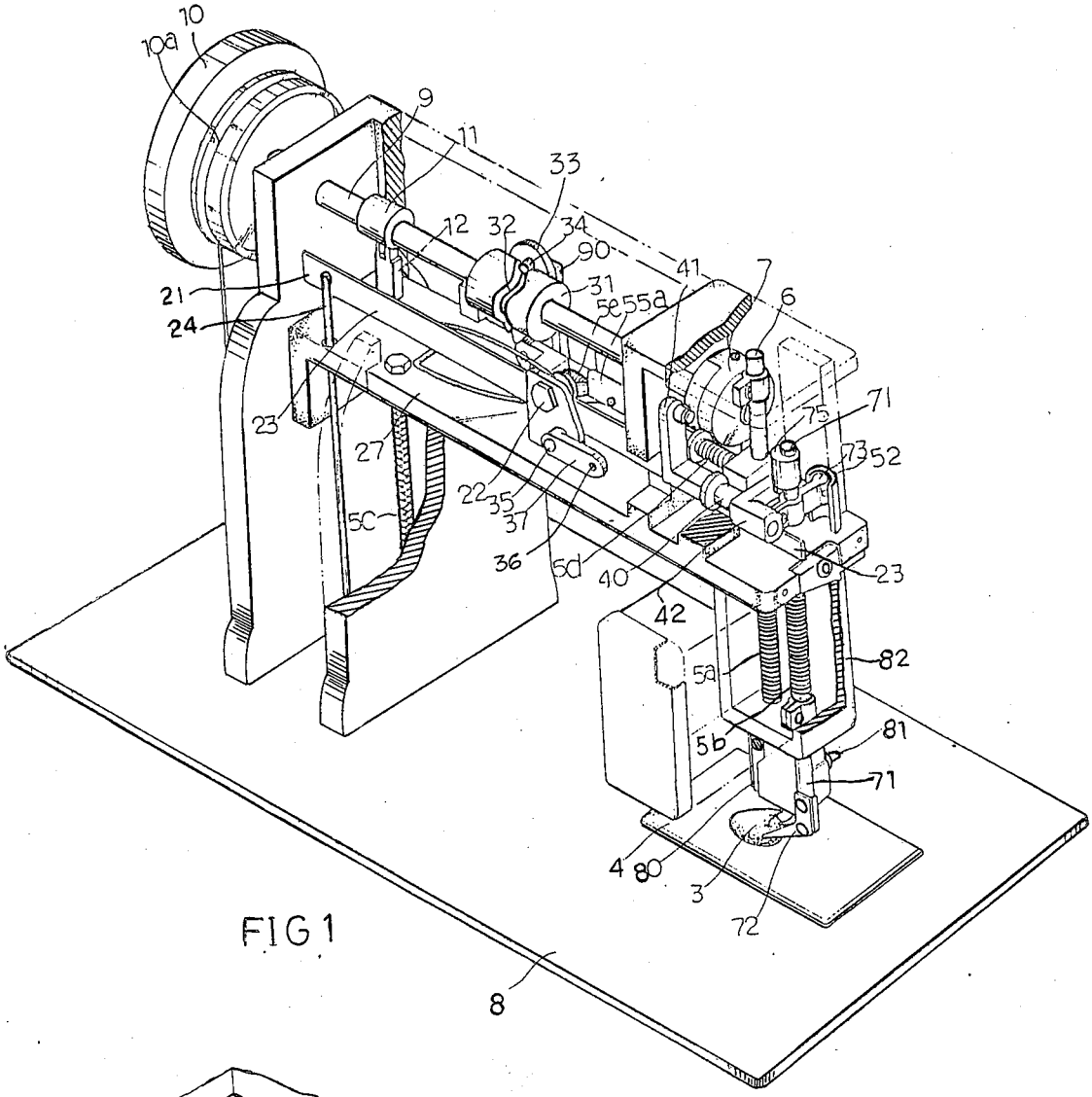
FIG 1
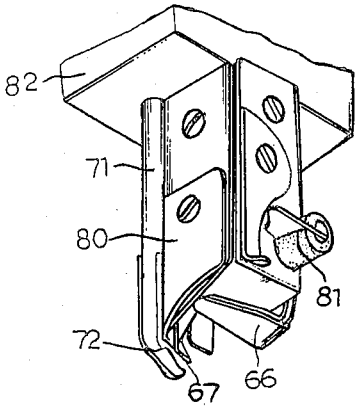
FIG 1-B
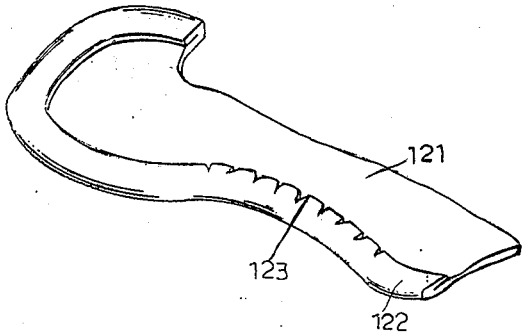
FIG 1-C

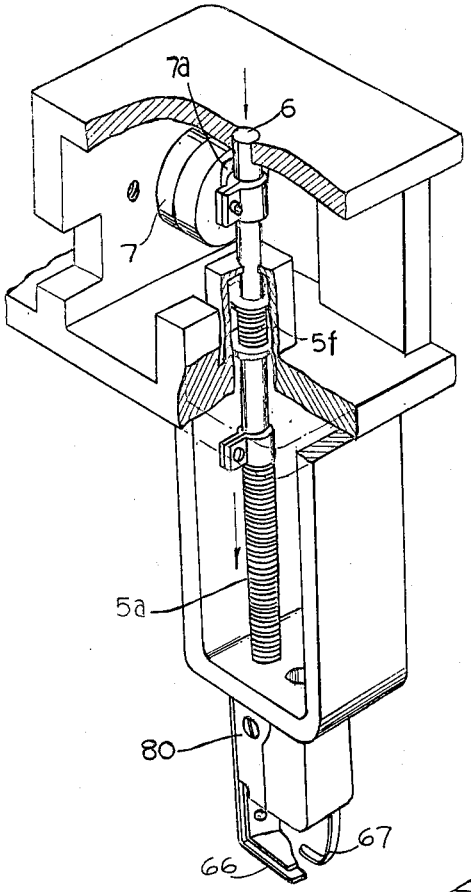
FIG.9
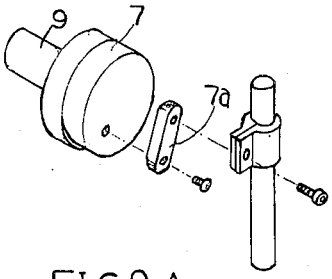
FIG.9-A
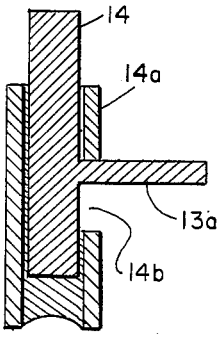
FIG. 10
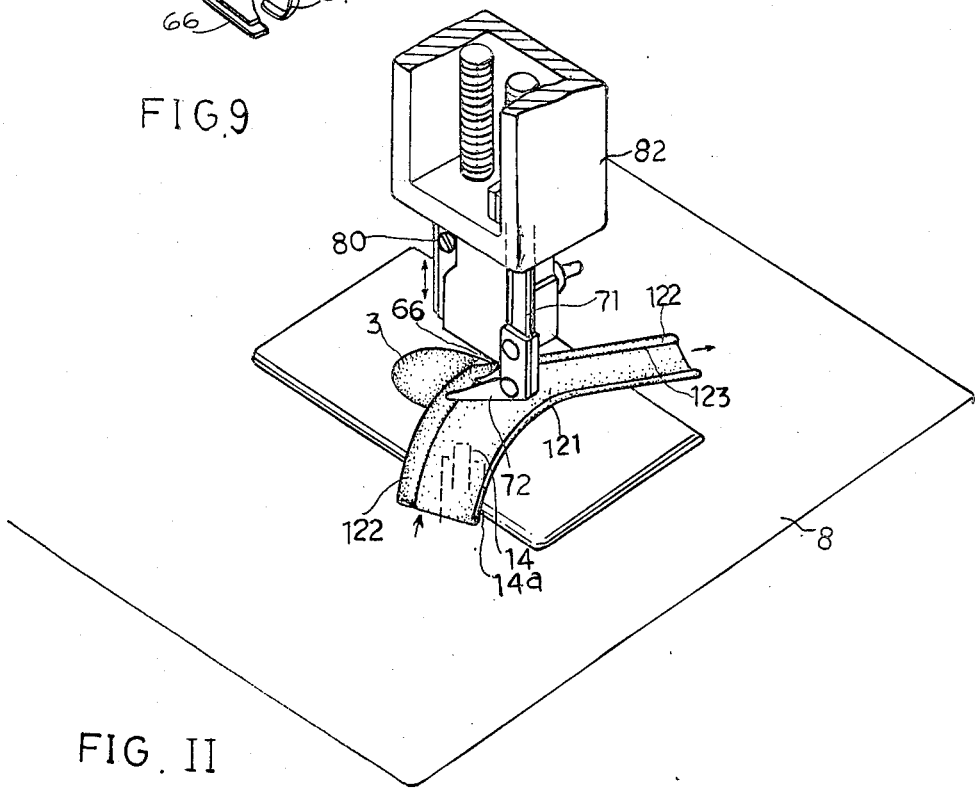
FIG. 11

LEATHER PRODUCT EDGING MACHINE

This application is a continuation-in-part of application Ser. No. 601,964 filed Apr. 19, 1984, now abandoned.

SUMMARY OF THE INVENTION

The present invention relates generally to the preparation of leather products, and, particularly to the manufacturing of the vamp and quarter of a shoe. It achieves a savings of labor as well as a promotion of product quality level by means of an automated edging and flanging operation.

The preparation of leather vamps is typically accomplished by first setting the pattern in the form of a vamp by cutting, and secondly, forming a pattern or form by flanging or edging to increase the rigidity or embellishing features of the vamp. Edging and flanging are traditionally done manually by one skilled in the art, who, as a rule, presses out the edge for hammering reinforcements by holding the hammer in one hand, and the flattening tool in the other hand. Shortcomings in such a traditional method of edging processing include fatigue on the part of the operator, whose mood or morale will leave its due effects on the setting of the edging as a function of the hammering strength, right or wrong, deviated or not. In short, workmanship can hardly be put under control in mass production with such a conventional procedure of preparation to the making of a shoe.

In recognition of the foregoing, resulting from the practices prevailing in most shoe making industries, the inventor undertook to develop improvements, and finally succeeded in the introduction of the present invention.

The primary object of the present invention is to provide an automatic machine for the preparation of a shoe so as to save the labor for other activities, at a substantial cut in production costs and a substantial increase in quality in mass production.

DESCRIPTION OF THE DRAWINGS

FIG. 1 is a three-dimensional perspective of the leather product edging machine, according to the invention, with the shell casing removed;

FIG. 1B is a bottom view of the connector uniting the underside of the machine of the present invention to the body;

FIG. 1C is an example of a leather product produced according to the invention.

FIG. 9A illustrates the longitudinal motion of the vertical pressing stem and associated parts, as activated by the eccentric cam of FIG. 9A. Arrows show direction of movement.

FIG. 9B illustrates the construction and attachment of the eccentric cam.

FIG. 10 illustrates, in cross-section, the structure of the support tube and associated parts. Arrows show direction of movement.

FIG. 11 shows the edging of a leather object using the device of the present invention. Arrows indicate direction of movement.

A description of some of the reference numbers: 3 bending mound, 4 operation board (preferably gloss-finished), 5*a*–5*f* recovery springs, 6 vertical pressing stem, 7 eccentric cam, 8 mounting surface, 9 cam shaft, 10 belt wheel, 11 cylindrical cam, 12 standing stem, 13 transverse guide stem, 14 radially extending support, 15 fix block, 21 advance recoiler, 22 fix fulcrum, 23 lever, 24 pull bar, 27 arm rest, 31 curved sheave wheel, 32 curved groove, 33 swing rod, 34 extension arm of the swing rod, 35 wrench adjuster, 36 screw hole, 37 adjustment lever, 38 insertion pin, 39 swing rod groove, 40 double bending shaft, 41 vertical elbow lever, 42 horizontal elbow segment, 43 fix block, 50 slide bar set dado, 51 slide bar, 52 kettle, 55 annular piece, 56 slide bar shaft, 57 annular piece shaft, 66 flanged member, 67 blade, 71 wrench stem, 72 wrench claw, 73 wrench arm, 75 fix cap, 80 connector, 81 adjustment knob, 82 work head, 90 swing rod fixer.

DETAILED DESCRIPTION

Figure 2:
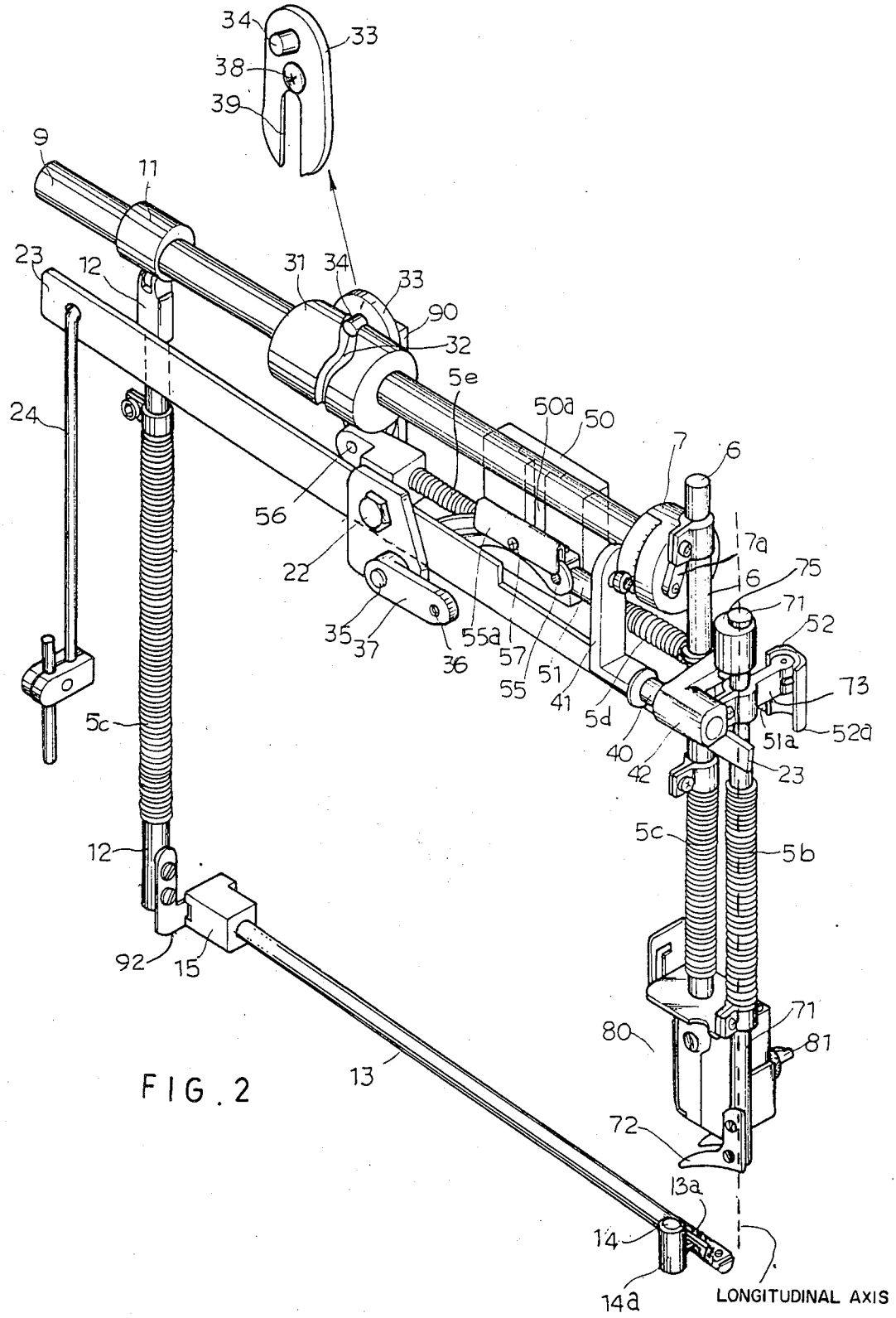
FIG. 2 is a three-dimensional perspective of the skeleton on which the structure according to the invention rests.
Figure 3:
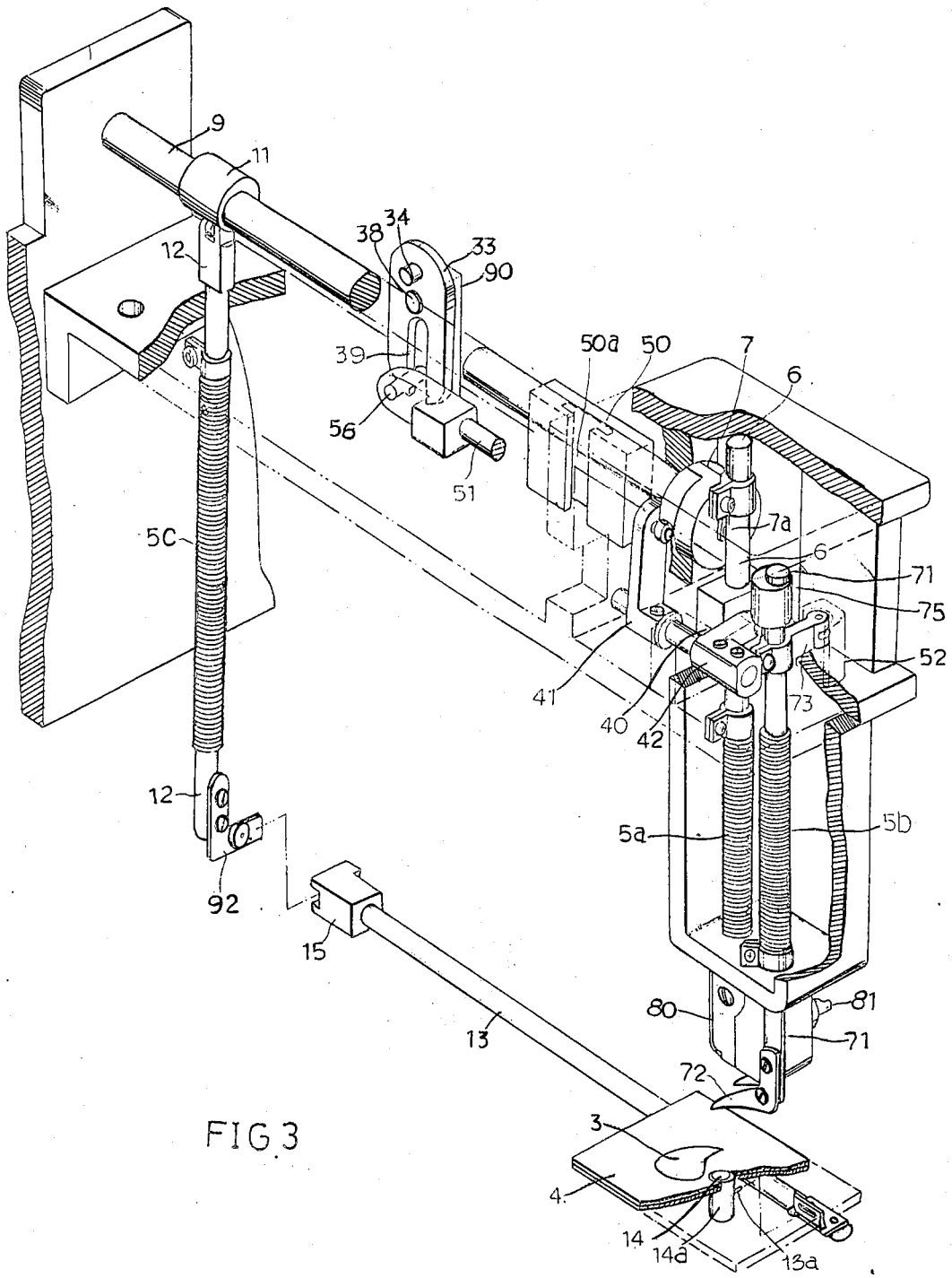
FIG. 3 is an exploded perspective showing the construction of the present invention, with certain parts removed, in relation to a cross-section of the frame to which it is attached.

Referring to the accompanying drawings it is seen that the invention, in the present embodiment, is structured to comprise: a loading and wrench claw 72 and accessories, serving to push the leather objects forward; a push speed, that is, push clearance adjustment unit 35 and accessories, serving to adjust the feeding speed of the leather objects; an advance recoiler 21, serving to lift claw 72 when it is desired to feed a series of leather objects for edging treatment by placing the object underneath claw 72; flanging member 66 and blade front 67 as shown in FIG. 1B, as provided below the vertical pressing stem 6, meant for press-setting edge fringe 122 and for cutting the same, as shown in FIG. 1C, in order to embellish the edging, or fringing of contoured or curved leather objects. A bending mound 3 having a cliffed face is provided in the direction into which leather products are provided on the operation board 4 relative to the mounting surface 8 and serves to guide a leather processing piece; a standing stem 12 controls support 14, as shown in FIG. 2, which bears ahead of the bending mound 3, and projects out of the access holes as provided on the mounting surface for the execution of up-and-down reciprocating movements, caused by the rotation of support 14, leading to the direction of movement of the front end of a leather object to be processed being in the same direction as the rotation of support 14.

Referring specifically to FIG. 1, it is seen that the belt wheel 10 is transmitted by means of a belt seated in groove 10*a* and driven by a power motor, not shown in the drawing. The belt wheel 10 in turn will drive camshaft 9 whose terminal end is provided with a cylindrical cam 11. Camshaft 9 also includes a curved sheave wheel 31 at its middle and an eccentric cam 7 provided at its front end. All these components will bring all the relevant components associated therewith, including claw 72, flanging member 66 and blade front 67, into synchronized or periodical movements once camshaft 9 is set to rotation. The activities of the transmission members are as follows:

As the cylindrical cam 11 at the terminal end of camshaft 9 rotates in synchronization with camshaft 9, it presses standing stem 12 discretely within the period of rotation. As a result, standing stem 12 presses against transverse guide stem 13 provided at the bottom of recovery spring 5*c* as shown in FIG. 2. The transverse guide stem 13 is fixed to the base of the mounting surface 8 by means of fix block 15 and rotates to force the radially extending support 14 over the operation board 4 through a hole or slot therein in order that the leather piece concerned may be guided in the direction of progression. Elbow 92 transmits the up and down motion of standing stem 12 into a restricted rotation of transverse guide stem 13. Connecting lever 13*a* connects transverse guide stem 13, through tube support 14*a* to radially extending support 14. The limited clockwise or counter-clockwise rotation of transverse guide stem 13 vertically displaces connecting lever 13*a* within slot 14*b* of tube 14*a*, which via its connection to radially extending support 14, causes that support 14 to move down and up, respectively.

When the camshaft 9 has rotated to a position so that cylindrical cam 11 is not in a position to bear against the standing stem 12, the standing stem 12 will then lift up to resume its initial status under the action of recovery spring 5*c*. In the meantime, the support 14 has moved downward into the hole or slot provided in the mounting surface 8, whereupon the curved sheave wheel 31 executes synchronized rotation together with camshaft 9 so that the curved groove 32 causes a swing rod 33 to execute a lateral swinging motion, as the flanging member 66 then drops to flat-press the flange or edge or fringe of the leather object, because extension arm 34 of the swing rod 33 is subject to sideways pushing force by curved groove 32 when it is set therein, as would appear apparent by reference to FIG. 2. An insertion pin 38 is provided in the middle of the swing rod 33 for bolting, in the capacity of a fulcrum, unto the fix block 90 for the machine body, so that the swinging of the top of swing rod 33 will cause the bottom thereof to swing sideways as well. From the terminal end of horizontal slide bar 51 there extends an axial arm 56 that will execute a horizontal reciprocating motion in the swing rod groove 39 in step with swing rod 33. The front of the slide bar 51 accommodates the fitting of a longitudinally set kettle 52, preferably about 3 cm in length, housing a wrench arm 73 above the wrench bar 71, the wrench arm 73 extending substantially radially from the wrench bar 71, the kettle 52 being united to the slide bar 51 at point 51*a*, kettle 52 and slide bar 51 together defining a horizontally extending arm, the wrench arm 73 being also united to the wrench bar 71. This arrangement causes the wrench bar 71 to execute a reciprocating rotation of less than 180° under the action of kettle 52 and wrench arm 73, due to the horizontal movement of slide bar 51. In turn, the claw 72 at the bottom of the wrench bar 71 executes a constant speed, reciprocating, progressive movement bringing an object leather piece to be fed into position, going short of 180°. The up-and-down movement of the claw 72 is further controlled by an active double bending shaft 40, as will be explained elsewhere in the text.

On the front tip of the cam shaft 9 there is provided an eccentric cam 7 with the shaft 7*a* thereof annexed to a swivel arm to carry the vertical pressing stem 6 into reciprocating longitudinal movements, so that a lowering of the pressing stem 6 causes a likewise lowering of the flanging member 66 at the bottom of pressing stem 6 to set-press the edging of a leather piece. When the press stem 6 lifts up, the claw 72, along with support 14, then positions the same leather piece for flat-setting. The outer rim of the eccentric cam 7, in the meantime, pushes against the vertical elbow lever 41 relative to the double bending shaft 40. The lateral displacement of the upper edge of vertical elbow lever 41 by eccentric cam 7, exerts torque upon double bending shaft 40 to rotate the same. The rotation of double bending shaft 40 in turn rotates affixed elbow segment 42. Horizontal elbow segment 42 extends from the double bending shaft 40, which passes behind the fix block 43 and is connected to a fix cap 75 attached to the top of the wrench bar 71. The rotation of elbow segment 42 causes vertical displacement of fix cap 75 and accordingly wrench bar 71. The wrench bar 71 is in its lowest position by the action of recovery spring 5*b*, as shown in FIG. 2, in the absence of the influence of the eccentric cam 7 via the vertical elbow lever 41 and the horizontal elbow segment 42. Concurrently, the slide bar 51 compels the kettle 52 to push the wrench arm 73 into rotation and thus cause the wrench bar 71 to rotate in conjunction with a downward movement in order that the wrench claw 72 in the course of progression, may feed the leather piece forward. Clockwise rotation of double bending shaft 40 lifts claw 72 in normal operation.

The advance recoiler 21, as shown in FIG. 1, functions mainly to lift up the wrench bar 71 outside the machine body as the operation begins. More exactly, advance recoiler 21 ensures that leather objects are cleared of the claw 72 and ready for automatic feeding, edging, and cutting operations once the motor is set at work. Activation of the advance recoiler 21 is done by stepping of operator's foot onto a pedal (not shown) provided at the bottom of a pull bar 24 outside the machine body whereupon the left end of lever 23 is pulled down, causing right end of lever 23 to lift the wrench arm 73 upward by virtue of fulcrum 22, to the effect that the wrench bar 71 as a whole will lift up to allow a leather piece to be fed to the underside of claw 72 with an edge thereof on the cliffed face of mound 3.

Figure 4:
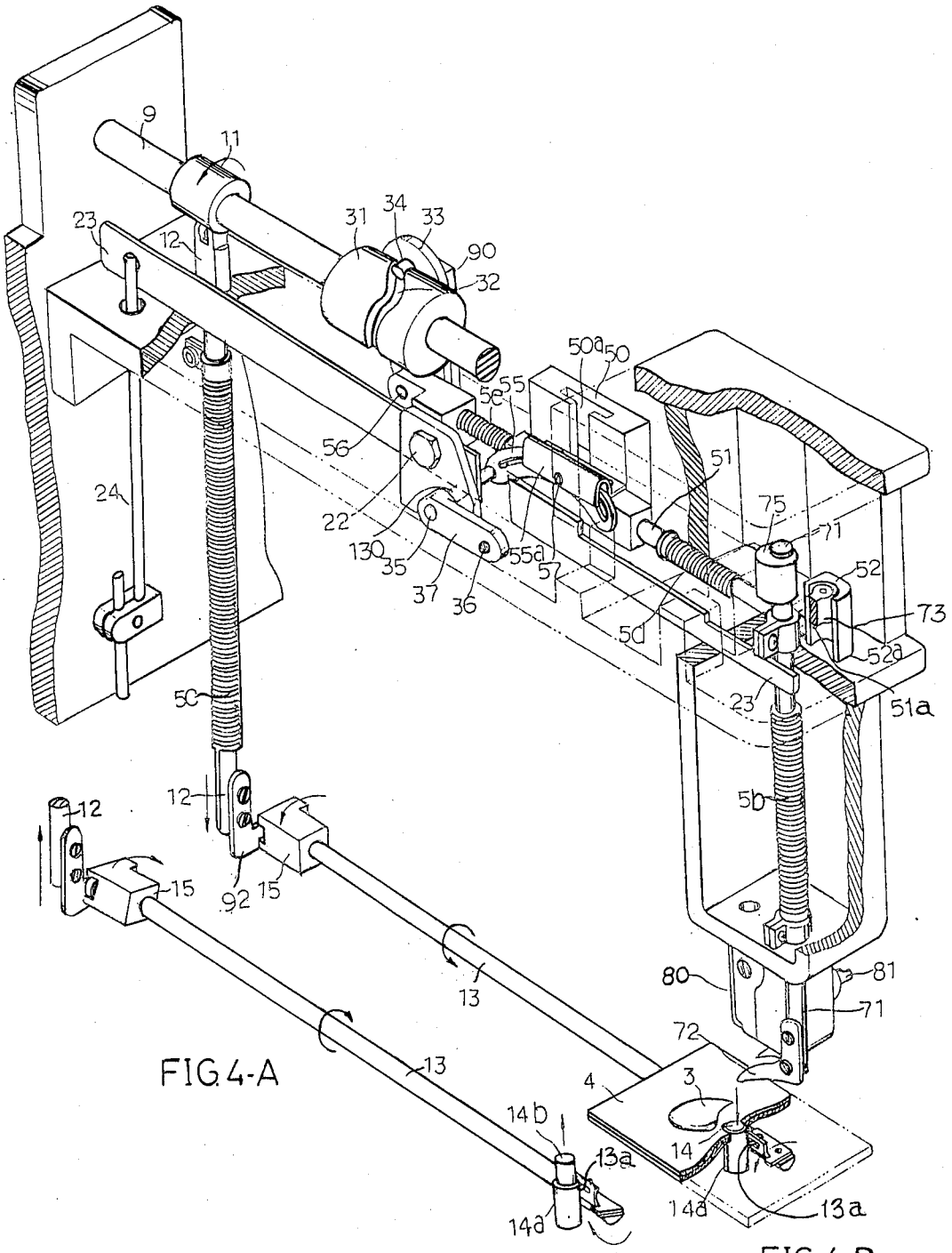
FIG. 4A a perspective of the invention similar to that in FIG. 3, except that other parts are included and other parts, including the vertical pressing stem, are removed. Arrows show direction of movement.
FIG. 4B details the construction of the transverse guide stem and associated parts. Arrows show direction of movement.
Figure 5:
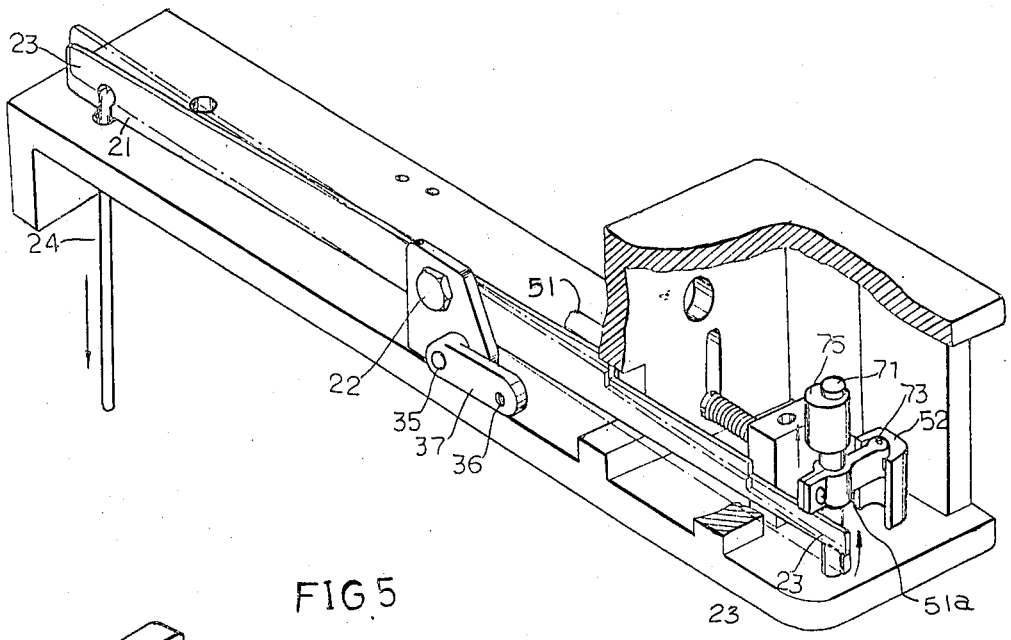
FIG. 5 illustrates the operation of the advance recoiling mechanism. Arrows indicate direction of movement.

Wrench speed adjuster 35 adjusts the magnitude of the rotation angle of claw 72. A smaller angle results in a smaller wrenching clearance, and hence a shorter range in which the claw 72 is in a position to wrench an object leather piece to be fed in. However, at the same time, the flanging member 66, as shown in FIG. 1B, will have a better chance to flat-press the fringe 122 (also referred to herein as edge 122), as shown in FIG. 1C. On thee other hand, a larger rotation angle results in a larger wrenching clearance, and hence a longer range in which the claw 72 may be fed, similar to an increase in working speed. However, there will also be a wider and scattered distribution of the length of an edge-pressed leather piece. In the screw hole 36 of the wrenching adjuster 35 there is fitted a screw, not shown in the drawing, from a point outside the machine body, which serves to adjust the wrenching clearance from a point outside the machine body. From the adjustment lever 37 there extends, at a right angle, a shaft 130, as shown in FIG. 4B, for fitting with an annular piece 55 relative to the horizontal slide bar 51, as shown in FIG. 2, for facilitating the adjustment of the position of the horizontal slide bar 51 in the longitudinal axis, high or low. Against the same annular piece 55 there extends, at a right angle, a shaft 57 for setting in a slide groove 50*a* and through slide brace 55*a* relative to slide bar set dado 50, to enable an adjustment of the adjustment lever 37. Upward movement of adjustment lever 37 will be accompanied by an upward displacement of the slide bar 51, the slide bar shaft 56, and the kettle 52 without causing any horizontal displacement whatsoever. The terminal end of the slide bar 51, engaged in the spring rod groove 39 for the swing rod 33 will lift up as well, thus causing the front end of slide bar 51, in the form of a kettle 52, to rise up accordingly, therefore the kettle 52 will be in a position to drive to the wrench arm 73 by means of the underside 52*a* thereof. The driving will come from the top of the kettle 52 when the horizontal slide bar 51 drops to the lowest level, as shown in FIG. 1. Drive to the horizontal slide bar 51 comes from the swaying of swing rod 33. The raising of the horizontal slide bar 51 causes the slide bar shaft 56 to draw closer to the fulcrum 38 of swing rod 33 so that the amplitude of swinging diminishes, resulting in a narrower clearance of slide bar 51 in sideways displacement. Thus, the return angle of the wrench arm 73 rotatively driven by the kettle 52 in front of the slide bar decreases to result in a yet narrower clearance of the wrench claw 72 associated therewith. By like reasoning, if the adjustment lever 37 is forced downward by pressure to the position as shown in FIG. 1, so that the slide bar shaft 56 in the swing rod groove 39 accommodating the setting of the swing rod 33, relative to the horizontal slide bar 51, bears apart from the fulcrum point 38 on the swing rod 33, there results an enlarged swinging amplitude. Hence the sideways displacement of slide bar 51 increases, thus achieving the objective of speed adjustments.

The connector 80 located at the bottom of the work head 82 is furnished with a blade 67 such that the blade 67 will cut out a slit 123 as shown in FIG. 1C on edge 122 of a leather object 121 in moments when the vertical pressing lever 6 drops low. These slits 123 further facilitate edging and flanging treatments of leather objects at the folded corners. If such blade cutting is not required, then the adjustment knob may be turned to place the blade 67 into a rest position. This arrangement is much the same as ordinary mechanical switches and will not be dealt with in further detail.

As should be clear from the above description, claw 72 and radially extending support 14 grip between them the leather object to be edged and move the leftmost edge (i.e., the edge closest belt wheel 10) of the leather object across the cliffed face of bending mound 3, thus bending that edge. Once the leather object is properly positioned, claw 72 is rotated out of the way and into position to advance the leather object. Meanwhile vertical pressing stem 6 is forced downward, causing flanging member 66 to press against the bent edge of the leather object just beyond the cliffed face of bending mound 3, causing the leather object to be creased and flanged. Flanging is improved by the action of blade 67, which, by virtue of its sharpness and the downward force exerted by vertical pressing stem 6, cuts the edge of the leather object bent by the cliffed face, prior to flanging by member 66.

To place the machine of the present invention into operation, the motor is run to drive the belt wheel 10 so that all associated parts may be driven to work, the wrench bar 71 feeding leather objects, the vertical pressing stem 6 flat-pressing edges, fringes, and flanges of leather objects into formation, all done automatically. Of course, advance regulation of the cylindrical cam 11, curved sheath wheel 31, eccentric cam 7 relative to the cam shaft 9 should be made concurrent with the machine body in the installation stage. Their operation period in relation to one another should be such that the wrench bar 71 can secure a close coordination with the vertical pressing stem in operation. The recommended rotation speed of said motor is 1,300–1,800 r.p.m. The recommended clearance of reach by each round of activation of wrench claw 72 is 2.5–7 mm.

Figure 6:
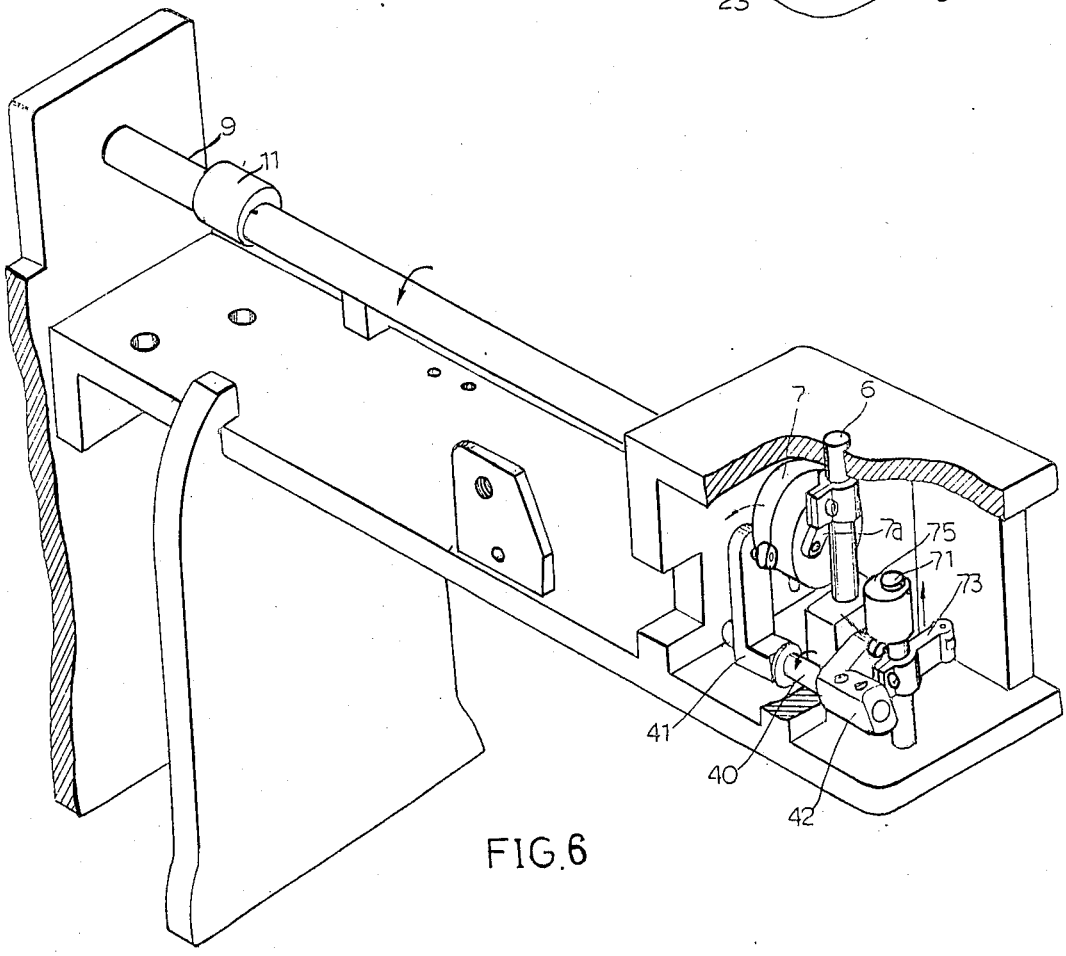
FIG. 6 illustrates the longitudinal movement of the wrench stem by rotation of the cam shaft. Arrows show direction of movement.
Figure 7:
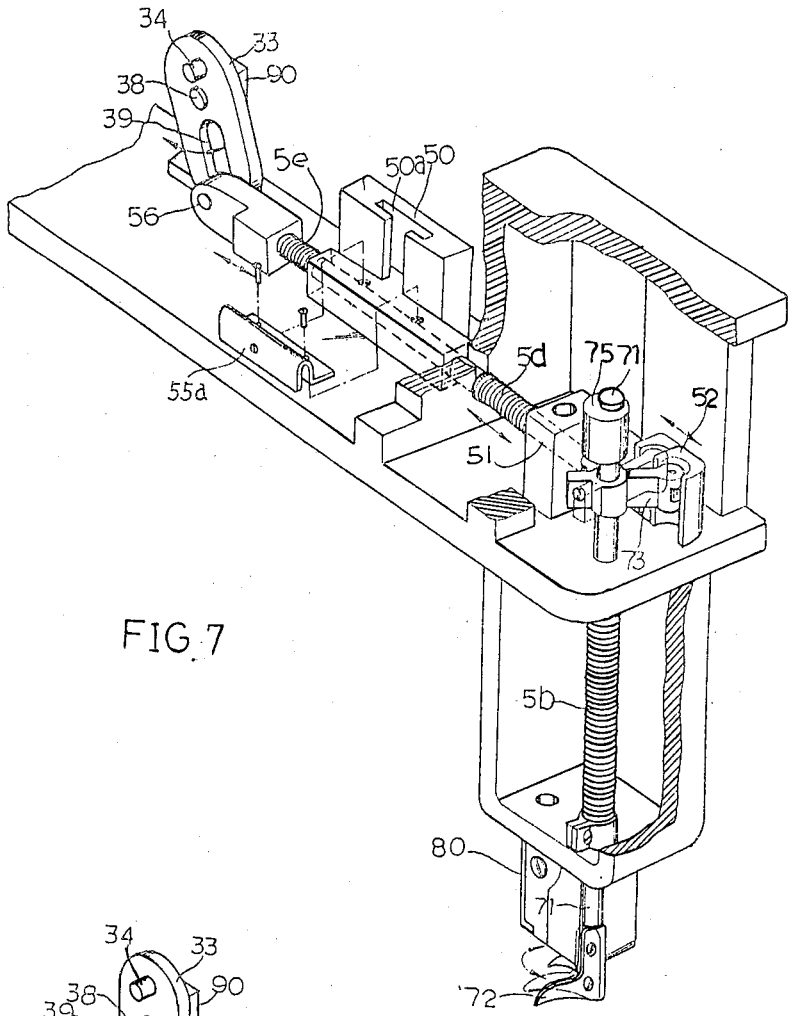
FIG. 7 illustrates the axial rotation of the wrench stem and associated claw when activated by the slide bar. Arrows show direction of movement.
Figure 8:
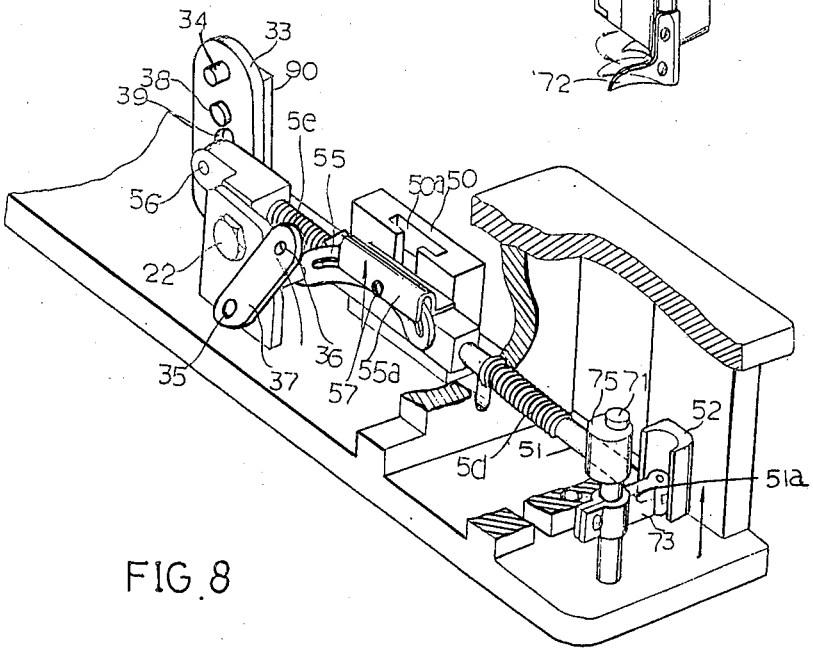
FIG. 8 illustrates wrenching adjustment. Arrows show direction of movement.

FIG. 11 shows that movement of wrench stem 71 is independent of head 80. Longitudinal movement of head 80, including attached blade 67 and flanged member 66 occurs as a result of longitudinal movement of pressing stem 6 (FIGS. 2 and 6).

When support tube 14 is in the down position, wrench stem 71, with claw 72 attached, lifts up and rotates counter-clockwise, while head 80 is in the up position. Tube 14 is raised and claw 72 moved downward and rotated clock-wise with wrench stem 71. Friction presented by support tube 14 and claw 72 as leather object 121 is grasped therebetween permits the clock-wise rotation of claw 72 to move the leather object in the direction indicated by the arrows of FIG. 11. Edge 122 is forced into and therefore bent upward by the cliffed face of bending mound 3. After this clockwise rotation of wrench stem 71 and claw 72, wrench stem 71 and claw 72 are raised, while, at the same time, head 80, under the influence of vertical press stem 6, is lowered (FIG. 6).

Therefore, blade 67 cuts a slit into a portion of edge 122 which has passed just beyond bending mound 3, prior to flanging of that portion by flanging member 66 (FIGS. 1B and 11), creating slit 123, while flanging member 66 presses upon an already cut portion of edge 122 which, of course, is also beyond bending mound 3, to flange edge 122. On the next cycle, the above portion cut by blade 67 is flanged by flanging member 66 and a new portion of edge 122 is slit by blade 67.

Each recovery spring 5*a*–5*f*, simply permits the return of the respective element about which it is placed to an initial position from which the element has been disturbed and the recovery spring stretched or compressed by that disturbance.

The above disclosure fully supports the assertion that the present invention removes many of the shortcomings found with the use of conventional manual machines, devices, installations, or the like, by the provision of automatic edging processing capabilities. Modifications of the above-disclosed invention by those skilled in the art may be made without affecting the nature of the present invention and such modifications are intended to be within the scope of the appended claims.

I claim:

1. A leather product edging machine comprising:

a mounting surface, upon which said machine is mounted, and means defining a hole in said mounting surface;

a belt wheel connected to a rear end of a camshaft so as to rotate said camshaft by the rotation of said wheel;

a cylindrical cam fitted to the end of the camshaft closest to the belt wheel for controlling a guide means for restricting the feeding direction of a leather piece, an eccentric cam on the front end of the camshaft for transmitting the movement of said camshaft to a vertical press stem to cause a longitudinal linear movement of said vertical press stem and to cause a latitudinally extending double bending shaft extending forward of said eccentric cam to force a wrench bar connected to said double bending shaft to execute a reciprocating longitudinal movement;

said guide means comprising a standing stem positioned below said cylindrical cam provided at the belt wheel end of said camshaft, said standing stem passing through a central bore of a spring, said spring being positioned above said mounting surface, and said standing stem extending below and through said mounting surface;

a transverse guide stem having two ends, one end being connected to the bottom end of said standing stem and passing beneath said mounting surface;

said transverse guide stem being rotatable about a longitudinal axis and having, at the other end thereof, a radially extending means for alternately engaging and disengaging with said hole defined by said mounting board by the rotation of said transverse guide stem;

a flanging member connected at a lower portion of said vertical press stem;

a blade connected to said lower portion of said vertical press stem;

a horizontal slide bar, parallel to and below said camshaft;

a horizontally extending arm attached to an upper portion of said wrench bar and united to said horizontal slide bar;

a sheath wheel, having a curved groove therein, positioned on said camshaft between said cylindrical cam and said eccentric cam;

means connected to said horizontal slide bar and fitting in said curved groove for laterally displacing said horizontal slide bar and by said lateral displacement, rotating said wrench bar about its longitudinal axis in response to a rotating movement of said camshaft;

said wrench bar having a claw on its lower end, the rotation of said claw and radially extending means acting together to grip a leather object and to guide said leather object across a bending mound on said mounting board, said mount having a cliffed face over which an edge of said leather object is guided.

2. A leather product edging machine according to claim 1, further comprising an elbow having a vertical member and a horizontal member, said members being connected to each other at ends thereof, said elbow contacting said eccentric cam at one free end of said vertical member and to said double bending shaft at a free end of said horizontal member, and an advance recoiler parallel to the camshaft, said advance recoiler comprising an oblong lever having two ends and means defining a hole between said ends of said oblong lever, one of said ends of said oblong lever supporting thereon said horizontally extending arm another end of said oblong lever being attached to a pull bar at a right angle to said pull bar, said pull bar extending downwardly from said oblong lever for manual control, and means passing through said hole in the oblong lever, for acting as a fulcrum whereby an operator may exercise manual control of the claw relative to the wrench bar to facilitate feeding of leather objects.

3. A leather product edging machine according to claim 1, further comprising a means for adjusting wrench clearance comprising a lever connected to a shaft, wherein the lever extends at a about right angle to said shaft, said shaft extending at a right angle to said horizontal slide bar and being connected, at a right angle thereto, to an annular portion defining a curved slot therein, said curved slot receiving slidably therein means connecting said annular portion to said camshaft and said horizontal slide bar, whereby the elevational level of the horizontal slide bar may be adjusted to accommodate latitudinal adjustment of the displacement of the wrench claw.

4. A leather product edging machine according to claim 1, wherein the mounting surface comprises a gloss-finished operating board, further comprising a work head having a top and bottom end, said work head being fitted about said vertical pressing stem and said wrench bar, a connector attached at its top end to the bottom end of said work head, said connector including said blade, said bottom end of said work head being connected to said claw, said operation board being positioned directly beneath said connector, said bending mound extending upward from said operation board.

* * * * *